US006673121B2

(12) United States Patent
Mettlach et al.

(10) Patent No.: US 6,673,121 B2
(45) Date of Patent: Jan. 6, 2004

(54) PROCESS OF CLEANING AND RESTORING GARMENTS

(76) Inventors: Douglas Mettlach, 132 Jenerts La., Ridgeville, SC (US) 29472; D. Angus Rae, 1644 Hwy. 17 North, Mt. Pleasant, SC (US) 29464

( * ) Notice: Subject to any disclaimer, the term of this patent is extended or adjusted under 35 U.S.C. 154(b) by 165 days.

(21) Appl. No.: 10/022,059

(22) Filed: Dec. 14, 2001

(65) Prior Publication Data

US 2002/0073491 A1 Jun. 20, 2002

Related U.S. Application Data

(60) Provisional application No. 60/255,550, filed on Dec. 14, 2000.

(51) Int. Cl.[7] ..... D06B 5/22

(52) U.S. Cl. ..... 8/149.1; 8/159; 68/5 A; 68/207

(58) Field of Search ..... 8/158, 159, 149.1; 68/207, 13 R, 5 R, 5 A

(56) References Cited

U.S. PATENT DOCUMENTS 5,241,720 A * 9/1993 Engel et al.
5,245,845 A * 9/1993 Langford
5,625,915 A 5/1997 Radler et al.
5,806,120 A 9/1998 McEachern
5,940,988 A 8/1999 Eisen
5,960,501 A 10/1999 Burdick
5,960,649 A 10/1999 Burdick
6,006,387 A 12/1999 Cooper et al.
6,045,588 A 4/2000 Estes et al.
6,115,862 A 9/2000 Cooper et al.
6,121,506 A 9/2000 Abel et al.
6,153,151 A 11/2000 Moxley et al.
6,418,580 B1 * 7/2001 Teran et al.
6,460,211 B1 * 10/2002 Chapman

* cited by examiner

*Primary Examiner*—Frankie L. Stinson
(74) *Attorney, Agent, or Firm*—B. Craig Killough

(57) ABSTRACT

A process of cleaning textiles, including textiles that are labeled dry clean only, without the use of large quantities of environmentally hazardous dry cleaning fluids such as those containing perchloroethylene or petroleum. The process uses hand treatment of soiled areas with a cleaning agent, with subsequent washing in water, followed by washing in ozonated water to remove the cleaning agent and the water. The textile is dried using a process that does not depend on tumbling of the textile in the presence of heat to dry the textile.

14 Claims, 4 Drawing Sheets

PROCESS OF CLEANING AND RESTORING GARMENTS

This application claims priority of provisional application serial No. 60/255,550, filed Dec. 14, 2000.

FIELD OF THE INVENTION

This invention relates to the cleaning of textiles generally, and is more specifically related to a process of wet-cleaning textiles that were heretofore cleaned by chemical dry-cleaning processes.

BACKGROUND OF THE INVENTION

The cleaning of textiles has been necessary for as long as humans have worn clothing. Textiles are commonly cleaned with water. To reduce the surface tension of water, and increase the effectiveness of the water cleaning process, surfactants are commonly added to the water. Further, to remove oil-based dirt and stains, emulsifiers are commonly added to the water to assist in removing oil from stains.

The use of water to clean textiles is almost always associated with substantial mechanical action, whether or not agents such as surfactants and emulsifiers are added to the water. Historically, this has included beating the textile with a rock in the presence of water, and in more recent times, is associated with washing machines having electric motors, which are designed to substantially agitate the textile in the presence of water and detergents.

Textiles are damaged by substantial mechanical action in the presence of water. Commonly used textile materials such as silks and wools may be ruined by machine washing with water. Wet-washing with detergents and mechanical action can damage fibers, cause shrinkage and remove dye from the fabric. This damage is further enhanced by elevated temperatures and harsh detergents.

Accordingly, many textiles are intended to be dry cleaned and are specifically labeled as "dry clean only". Dry cleaning processes are well known, but in summary, dry cleaning processes may be more accurately described as non-aqueous cleaning, rather than "dry" cleaning. Textiles are introduced into a solvent, and are agitated in the presence of the dry cleaning chemical solvent. This solvent removes dirt and stains by solubilizing or emulsifying the dirt and stains. The materials removed from the garments, which are suspended or dissolved in the dry clearing fluid, are carried away with the fluid, which is filtered to remove particles.

The solvents that are typically used in dry cleaning processes will remove both oil based stains and dirt, and with added soaps stains and dirt that are otherwise water-soluble. Dry cleaning solvents are typically organic. The solvents which have been in primary use in dry-cleaning are perchloroethylene based dry cleaning fluids.

Most dry cleaning fluids in common use, particularly including those which include perchloroethtylene, are toxic. They are both an environmental hazard and a health hazard. Disposal of used perchloroethylene based dry cleaning fluids, as well as other known dry cleaning fluids, has become a substantial health and environmental problem The use of water to clean textiles is preferred, since the associated environmental and health problems are reduced. Heretofore, textiles that are labeled dry clean only could not be commercially cleaned using a water based process.

Any cleaning process that involves water is dependent on four factors: time, temperature, chemicals and mechanical action. According to the International Fabricare Institute, most wet cleaning cycle times range from 13–19 minutes, at a temperature of 80–89° F. The chemical agents used in most commercial processes are neutral to slightly acidic, and have a pH in the range of 6.5–7. Mechanical action is substantial, lifting the clothing to the 10 o'clock position of the cylinder, and reversing to the 2 o'clock position in most machines, although some lift to the 9 o'clock and 3 o'clock positions. The clothing lifts and falls within the cylinder to mechanically agitate and achieve cleaning. Most washers apply a G-force of 0.6 to 0.7 G during the wash cycle, which is increased upon water extraction to 250–460 G.[1] The time, temperature, chemicals and mechanical action that are used in commercial wet cleaning processes, as described, will damage textiles that are labeled "dry clean only".

[1]Source: International Fabricare Institute

SUMMARY OF THE INVENTION

The present invention is a process of cleaning textiles, including textiles that are labeled dry clean only, without the use of large quantities of environmentally hazardous dry cleaning fluids, such as those containing perchloroethylene or petroleum. The textile, such as a garment that is labeled dry clean only, is treated by hand, applying at least one cleaning agent to at least one soiled area of the garment which is labeled for dry cleaning. The garment is washed in water to partially remove the cleaning agent, and to remove soil from the garment, including soil loosed or emulsified by the cleaning agent. Chilled ozonated water is used to further remove the cleaning agent, and to remove the water from the garment. The garment is the dried at a temperature imparted to the garment of not more than 55 degrees Celsius.

The garment is primarily cleaned by the hand application of the cleaning agent, which does not damage the dry clean only fabric. The use of the ozonated water removes the cleaning agent and the water. Ozonated water dries faster than water, and is more effective than water at removing the cleaning agent, so that the dry clean only garment does not materially shrink or deform. The garment is dried without exposing the garment to heat at the levels normally used by commercial laundry dryers.

DESCRIPTION OF THE PREFERRED EMBODIMENT

The process of the present invention is intended to replace, or to reduce the use of, known commercial dry cleaning processes. Accordingly, the description herein is very typical of a preferred embodiment of the process, as it would be used by a commercial laundry or textile cleaner.

Figure 1:
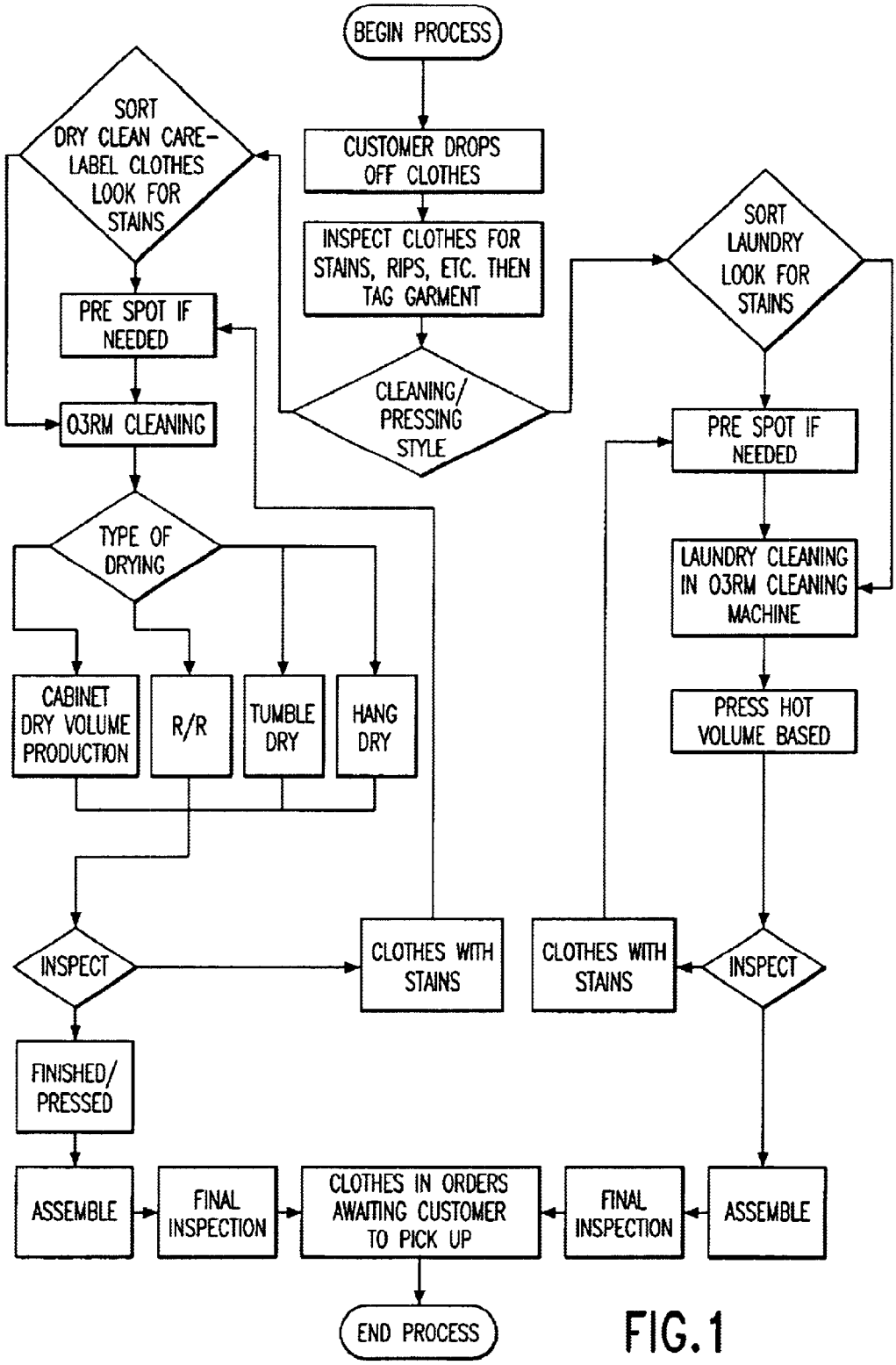
FIG. 1 is a flow chart demonstrating the process of an embodiment of the invention.
Figure 2:
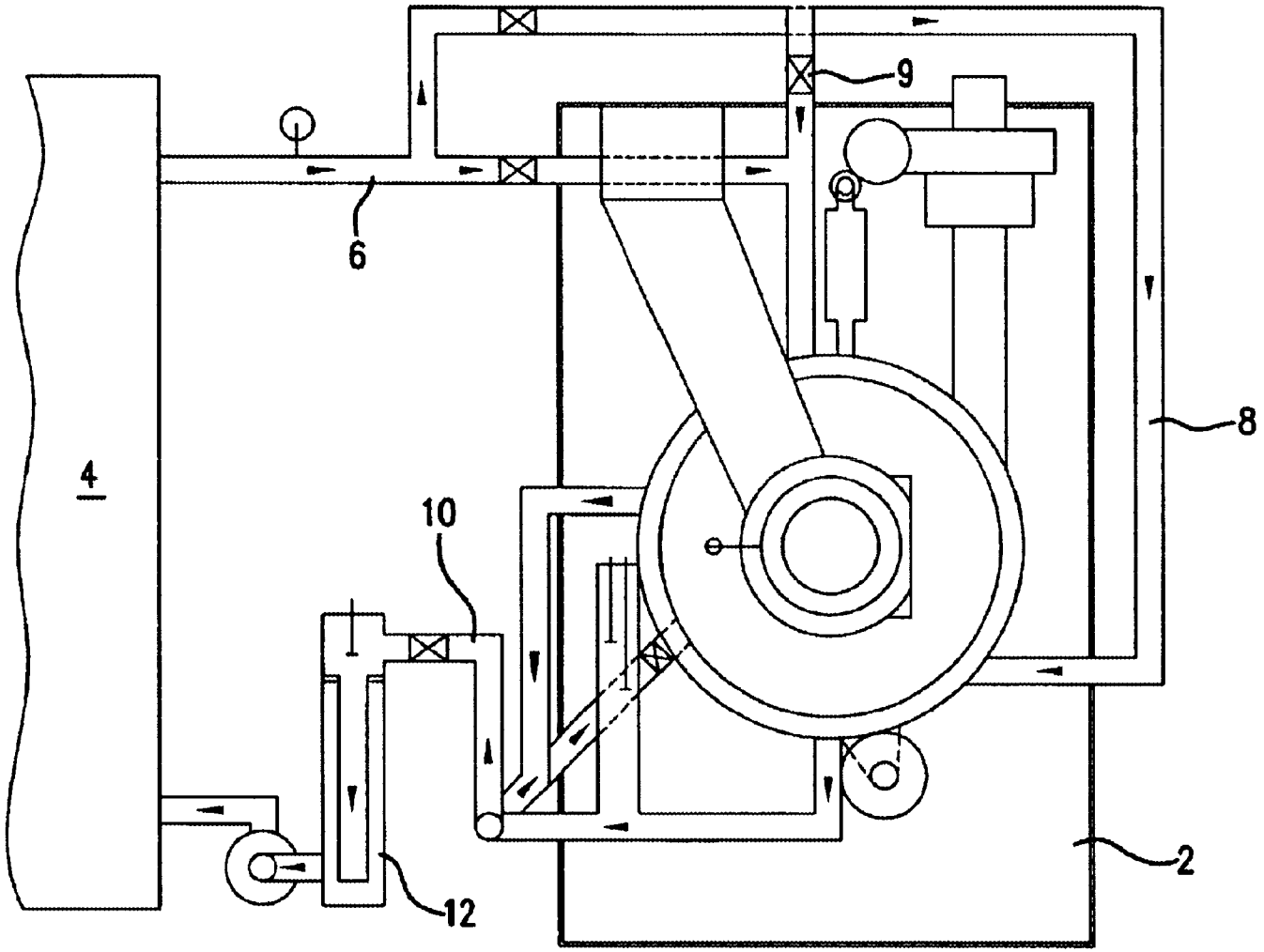
FIG. 2 is an elevation of a device for practicing wet cleaning according to an embodiment of the invention.
Figure 3:
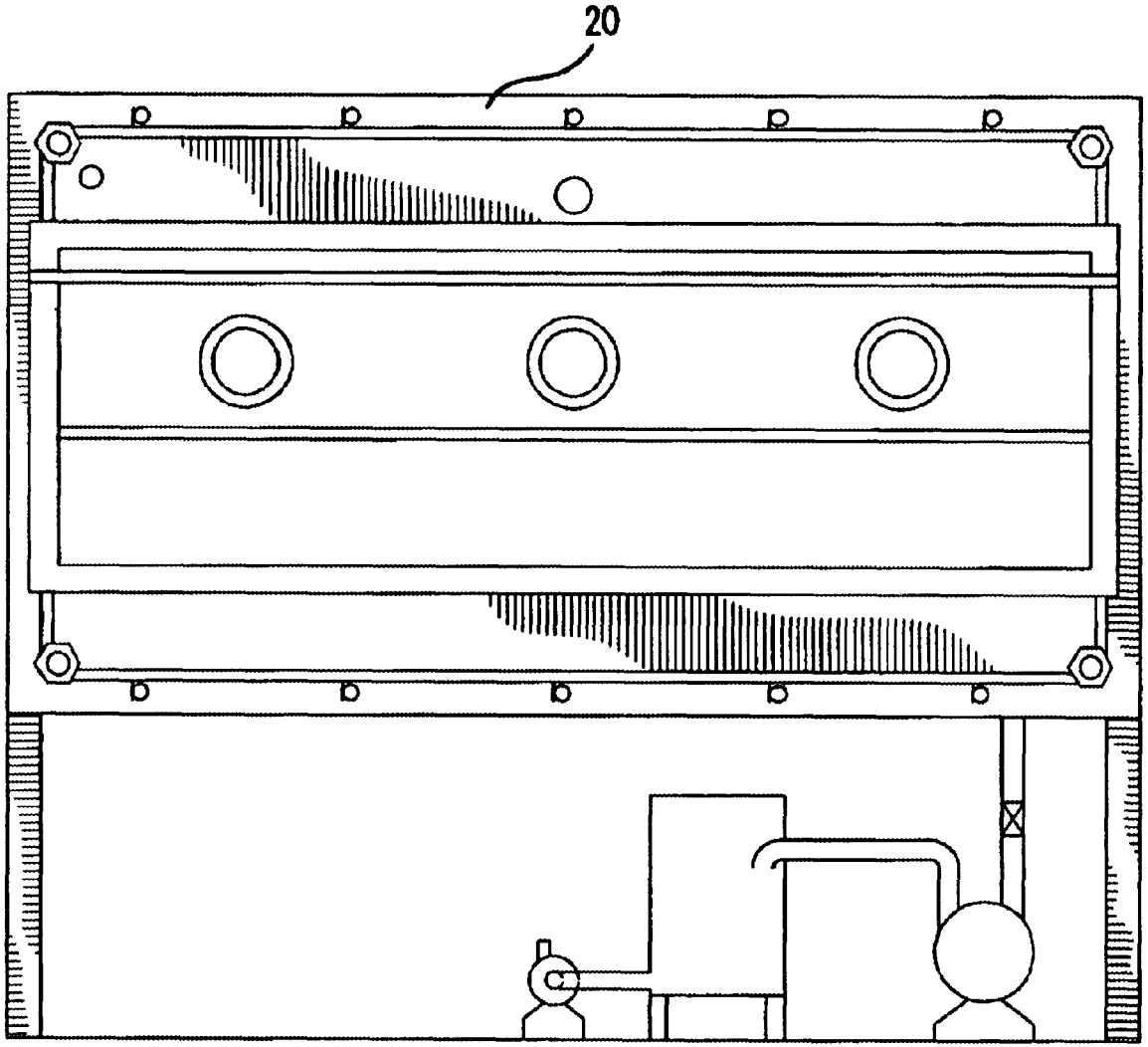
FIG. 3 is an elevation of a device for vacuum drying textiles according to an embodiment of the invention.
Figure 4:
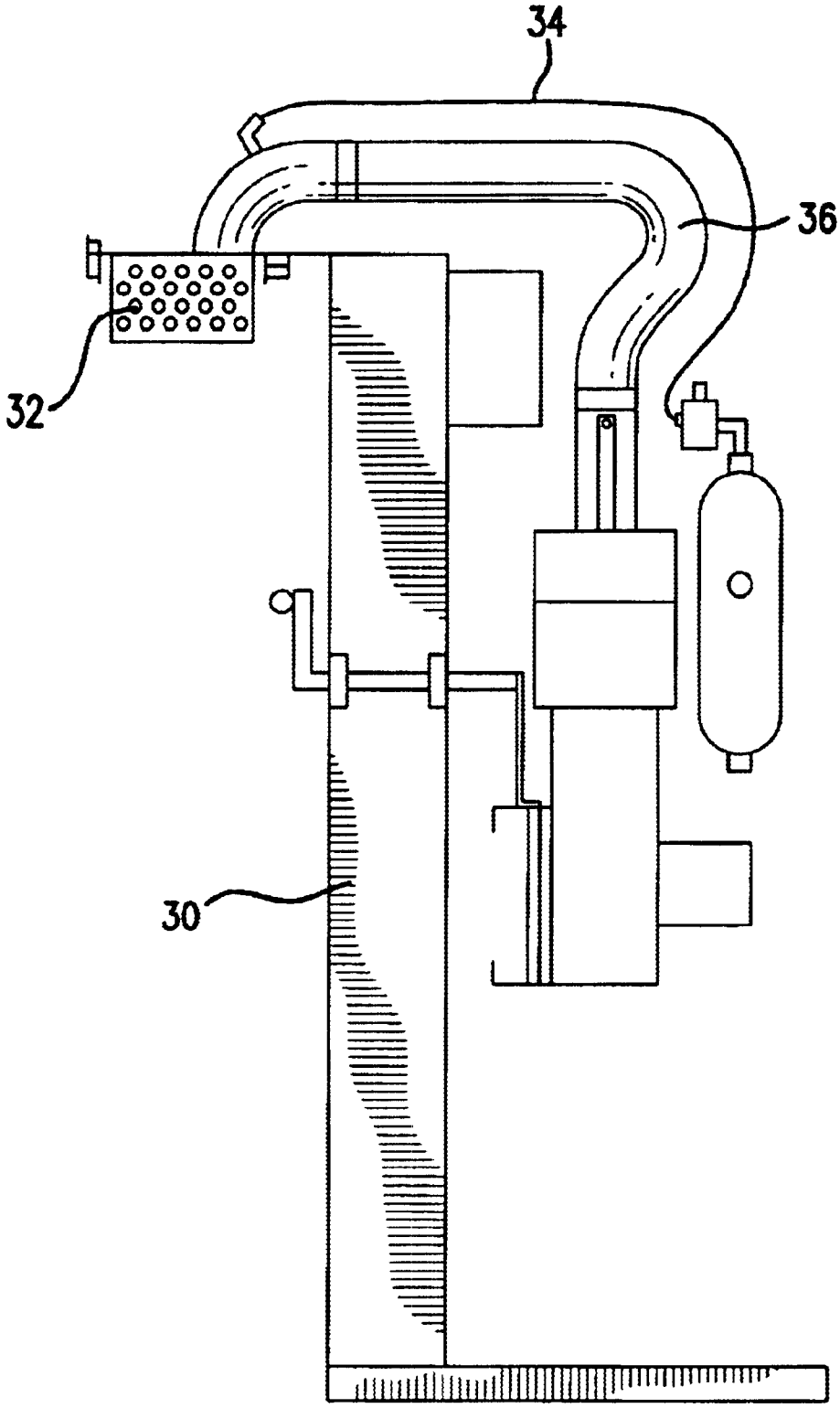
FIG. 4 is a side elevation of a restorer/refinisher.

Refer to FIG. 1, which is a flow chart of the process ("O3RM Process"). It is preferred that garments are sorted by care labels and fabric content. Like fabrics should be matched with like fabrics. Fabrics are matched according to a percentage of a particular fiber. Fabrics which can be cleaned with the process of the present invention include, but are not limited to, silks, wools, acetates, polyesters, nylons, rayons, cotton, angora, cashmere (and other animal hair), animal hides, metals, and glass.

Empirical observation will permit the process described herein to be refined so that each fabric type may be optimally cleaned. Accordingly, sorting of the fabrics is for the purpose of optimal cleaning of the fabrics and not because the mixing of fabrics will cause, or result in, damage to the fabric if various fabrics or colors are mixed within the process. The variables, which may be changed according to the fabric, include cycle times, water temperatures, load sizes, drum rotation, particular surfactants and sizings and conditioners to be used.

Either before or after the fabrics are sorted, but preferably after, the garment is inspected for soiled areas and fabric stains, and are cleaned by hand with one or more cleaning agents. The cleaning agents may be acid-based or alkaline-based products with surfactants and emulsifiers. Removal agents, which include enzymes and oxygen bleach, may also be used.

After the garments are separated, and hand cleaned, the textiles are introduced into a compatible laundry machine 2. An example of a laundry machine to be used is a MARVEL AQUADRY. This cleaning machine should not be overloaded, since a low level of rotation for water circulation is desired. Overloading may prevent a proper level of water circulation, or cause excessive mechanical interaction between the garments.

Water is introduced into the machine to an appropriate level. The type of garment determines the water level and type of water. It is preferred that dechlorinated, filtered, and softened water be used. Water temperatures should not be greater than room temperature, and room temperature is preferred not to exceed 80° F. Chilled water or ozonated water is optimal, and will produce superior results.

The cleaning machine is the actuated. An example of a cleaning machine that may be used in the process is a front-loading, wet cleaning laundry machine having a rotating drum with multiple spines or paddles in the drum. These spines and paddles are intended to provide agitation for prior art laundry processes, which impart substantial mechanical action and kinetic energy to the textiles. However, when the machine is used with the present process, it is placed on a low RPM setting, and usually the lowest setting available. It is imperative that a slow rotational speed for the drum be used, so that very minimal agitation of the clothing occurs. For most laundry machines with a motor controlled by a inverter, the lowest setting for the rotational speed of the drum should be used, along with a relatively high level of water, so that there is no material lifting of individual textile objects above the water line, nor is there the associated falling of the textile. The rotation of the drum should not cause the spines to lift the garment or other object materially above the level of the water, when the machine is ¾ full of water. In a preferred embodiment of the device, the rotational speed of the drum is 11 revolutions per minute or less.

A surfactant is introduced into the water. The surfactant should be pH neutral. To achieve the results required by the process, the process uses little mechanical agitation in combination with mild surfactants. The use of a surfactant that is highly alkaline is detrimental to the fabric, just as too much mechanical energy and heat energy is detrimental to fabric.

The time of continued operation of the machine is determined by the fabric to be cleaned and the level of foreign materials and stains in the fabric. Typically the time of operation of the machine for this step ranges from 2 to 20 minutes. This initial cycle removes at least some of the cleaning agent and the soil from the garment by means of the water, and if used, the surfactant. Cleaning during this cycle, as well as during all other steps of the process, does not occur as a result of kinetic energy imparted to the clothing by the cleaning machine, as is true in prior art processes. The operation of the machine mixes the water with the textile, but it does not clean by beating or pounding the textile, or by lifting the garment materially above the water line in the cleaning machine and dropping it, which is what is meant herein when it is stated that the cleaning machine does not remove soil by imparting kinetic energy to the garment or textile.

After the machine is operated for the appropriate time, water is removed from the machine. Optionally, a cylinder stop or medium drum rotation can take place at this time to prevent agitation of garments during drain. A fan or blower may be operated to assist in water removal from the machine and the textiles.

The machine is then filled to ¾ of the maximum water level with ozonated water. Ozonated water is produced by dissolving ozone ($0_3$) in the water. The ozone of a concentration within the water is preferred to be 1.5–2.5 parts per million (ppm). The ozone level is appropriate if a reading of 900 to 950 millivolts is obtained, as measured by a gauge, which indicates oxidation-reduction potential or other known instrumentation. An example of a device for producing ozonated water is the TECH 2 OZONE™ system manufactured by AJT.

As shown in the drawings, water flows from the ozone generator 4 through a line 6 and into the machine. An additional line 8 may be provided. "City" water may be provided to the machine though a valve 9 as desired.

The ozonated water is preferred to be chilled. Superior results are achieved if the water has a temperature of 10–18° F. Just as mechanical agitation and harsh soaps or other chemicals are detrimental to fabrics, and particularly, dry clean only fabrics, heated water is detrimental to fabrics, and should be avoided. The use of chilled water produces superior results as compared to the use of water that is at room temperature. Chilled water more readily accepts the introduction of ozone.

The ozonated water is constantly circulated within the system, so that ozone is continuously introduced into the water as needed to maintain the appropriate level of ozone in the water that is present in the machine. A recirculation line 10 to the ozone generator 4 is provided. By monitoring the water, an appropriate level of ozone can be maintained with a 1.5 to 2.5 ppm indication maintained on the gauge. An ozone probe can be installed in a machine overflow or bypass to indicate garment cleaning. As the ozone eliminates foreign organic materials that were present in the textile, ozone is maintained at higher levels within the water indicating that the cleaning process is near completion, or is completed. An ozone concentration of more than 3.0 ppm will degrade many textile dyes, and must be avoided when used to clean dry clean only garments.

As the ozonated water is slowly agitated in the machine, ambient gasses will dissolve in the water, making it difficult to maintain the desired level of ozone in the water. It is preferred to remove these gasses from the water after the water exits the machine and prior to entering the ozone generator during the recirculation process. A gas removal device 12 is preferred to be used during recirculation.

The ozone removes the remaining cleaning agents. The ozonated water also removes the water. Ozonated water dries faster than water that is not ozonated, so that shrinking and deformation of the dry clean only garment is reduced or eliminated, which is a key to the efficacy of this process of wet cleaning of dry clean only garments.

Optionally, an additional wash cycle may be used. This wash cycle may use a combination of ozonated water and filtered or softened water. If this additional step is used, it is preferred that the machine is partially filled, such as to ¼ of the maximum level, with softened or filtered water. Sizing and/or conditioner may be introduced at this time. The fill may then be completed using ozonated water. Typically, the ozonated water will not be recirculated during this step. Again, slow rotation is provided by means of a machine for a period of three (3) to five (5) minutes.

The water is removed from the machine upon completion of the cycle. The optional cylinder stop, medium drum rotation or blower or fan may be introduced. Excess water is then removed from the garment with the use of the extract cycle on the machine, although imparting significant kinetic energy to the garment is undesirable.

After the extract cycle is completed, the clothing is removed from the machine. The clothes are then dried. It is important that excess heat or mechanical action not be introduced to the textiles. However, commercial processes demand that drying of the textiles take place as quickly as possible.

In the present process, a vacuum dryer 20 and/or a refinisher/restorer device are preferred to be used. The vacuum dryer operates at 28 inches of vacuum or less within a sealed chamber with heated infrared lights. The infrared lights should not impart more than 55° C. to the garments, and it is preferred that not more than 120° F. (49° C.) be imparted to the fabric. The combination of vacuum and infrared lights expedites the drying of the garments, without heat buildup, due to an evaporation effect. Tumbling the garment is not needed, thereby meeting a goal of the invention of not imparting impact energy to the garment during processing.

The vacuum dryer of the preferred embodiment is used by opening the door of the device, and pulling a rack out of the interior of the device. The wet garment is positioned so that it is flat on the rack, in as natural a position as possible. The rack is placed into the device and the door is closed. The drying time and temperature are set, taking into consideration garment color, fabric type, and thickness. The device is actuated, and vacuum is applied, along with infrared lights for infrared heat, until the garment is dry. The garment is then removed from the device. To expedite water vapor removal, airflow to the vacuum pump may be provided.

A restorer/refinisher 30 may be used to reshape garments. Garments are staged on the refinisher/restorer according to the type of garment. Openings on garments are substantially closed with buttons, clips or clamps. Pressurized hot, or ambient, air and steam are introduced into the inside of the garment. Weights may be attached to lower portions of the garment. This process relaxes fibers and conditions the garments prior to finishing.

The restorer/refinisher is designed to condition garments before finishing. The restorer/refinisher will process long and short garments; both tops halves and bottom halves, such as shirts and pants, or jackets and skirts).

The garment is staged by positioning the garment on the device, then closing, such as by clamping or buttoning, all openings, such as pant cuffs, skirt hem, or skirt. The restorer/refinisher has adjustments for air temperature, blower forced pressurized air, time, dry steam time, dry steam, ambient air time, amount of air pressure, waist size, auto cycle and manual cycle. With these controls, an operator will accomplish conditioning of almost any wet garment to its intended shape.

The operator stages garment on restorer/refinisher, sets dry steam injection time, hot air temperature, air pressure, hot air pressure time, ambient air pressure time, height, and cycle. Steam pressure to the restorer/refinisher is preferred to be at about 80–90 psi. The device is actuated. Dry steam is injected into garment via an expander 32 supplied by a steam line 34. This controllable level of steam will relax the fibers of the garment. Hot pressurized air is then blown into the garment tot the point of garment pillowing out (balloon like), but within preset limits so to prevent exceeding the garments design and manufactured strength. The process dries the garment from wet to dry, removes wrinkles, and stretches fibers if needed back to their intended shape per manufacturing. Ambient air is then blown into the garment through an air duct 36 to cool down the garment so to prevent shocking of fibers (yielding possible garment distortion if not evenly cooled) and operator comfort when removing the garment form machine. When the cycle stops, the operator inspects and removes the garment.

Performance time of drying and reshaping is relative to the fabric weave thickness and layers of fiber bearing a saturation percentage of water in the garment. The tightness or looseness of the fibers, which allows the air to escape the inner cavity of a garment, is also a factor. If a loose weave in the fibers, then more air flow is used to increase evaporation.

The restorer/refinisher operates through a combination of:

1) Dry steam
2) Adjustable blower yielding forced, steam heated air, and forced ambient air, either together, or separately
3) Gravity
4) Forced Air Pressure The present invention demonstrates that immersing garments in water and drying without mechanical action with limited heat can successfully clean and condition "dry clean only" garments. However, dry clean only garments cannot be cleaned in the presence of water if substantial mechanical action along with heat that is materially above ambient temperatures, or harsh alkaline detergents, are used. The present process will effectively clean dry clean only garments without damage to the garment, and minimal shrinking or fading of dyes or pigments, which are used to color the textiles. The process uses water, substantially neutral surfactants, and low energy imparted to the textile by the use of low temperatures and low mechanical action, in both the cleaning and drying cycles, to achieve the successful cleaning of dry clean only textiles.

What is claimed is:

1. A process of cleaning textiles, comprising the steps of;

a. applying at least one cleaning agent to at least one soiled area of a textile which is labeled dry clean only;

b. introducing said textile to water and mixing said water and said textile, and removing said cleaning agent and soil from said textile, wherein said cleaning agent or said soil are not materially removed by imparting kinetic energy to said textile;

c. introducing chilled ozonated water to said textile to further remove said cleaning agent and to remove said water from said textile; and d. drying said textile at a temperature imparted to said textile of less than 55 degrees Celsius.

2. A process of cleaning textiles as described in claim 1, wherein said textile is dried by the application of vacuum to said textile.

3. A process of cleaning textiles as described in claim 1, wherein said chilled ozonated water contains not more than three (3) parts per million of ozone.

4. A process of cleaning textiles, comprising the steps of;

a. applying at least one cleaning agent to at least one soiled area of a textile which is labeled dry clean only;

b. introducing said textile to water and removing said cleaning agent and soil from said textile by mixing said water and said textile in a cleaning machine, wherein said cleaning machine does not remove said cleaning agent or said soil by imparting kinetic energy to said textile;

c. removing said water from said cleaning machine;

d. introducing chilled ozonated water to said textile in said cleaning machine to further remove said cleaning agent and to remove said water from said textile, wherein said cleaning machine does not materially remove said cleaning agent or said soil by imparting kinetic energy to said textile;

e. removing said textile from said cleaning machine;

f. drying said textile at a temperature imparted to said textile of less than 55 degrees Celsius.

5. A process of cleaning textiles as described in claim 4, wherein a drum of said cleaning machine is operated at or below eleven (11) revolutions per minute.

6. A process of cleaning textiles as described in claim 4, wherein said chilled ozonated water is recirculated from said cleaning machine to an ozone generator that increases the ozone level in the chilled ozonated water and back to said cleaning machine.

7. A process of cleaning textiles as described in claim 6, wherein an ozone level of said ozonated water in said cleaning machine is monitored, and wherein said ozone level indicates when said textile is to be removed from said cleaning machine.

8. A process of cleaning textiles as described in claim 7, wherein said chilled ozonated water which is present in said cleaning machine contains not more than three (3) parts per million of ozone.

9. A process of cleaning textiles as described in claim 6, wherein dissolved gas is removed from said chilled ozonated water after exiting said cleaning machine and prior to entering said ozone generator during recirculation of said chilled ozonated water.

10. A process of cleaning textiles as described in claim 9, wherein said chilled ozonated water which is present in said cleaning machine contains not more than three (3) parts per million of ozone.

11. A process of cleaning textiles as described in claim 6, wherein said chilled ozonated water which is present in said cleaning machine contains not more than three (3) parts per million of ozone.

12. A process of cleaning textiles as described in claim 4, wherein said textile is dried by the application of vacuum to said textile.

13. A process of cleaning textiles as described in claim 4, wherein said textile is conditioned after removal from said cleaning machine by attaching one or more weights to said textile and introducing steam into an interior of said textile.

14. A process of cleaning textiles as described in claim 4, wherein said chilled ozonated water which is present in said cleaning machine contains not more than three (3) parts per million of ozone.

* * * * *